United States Patent [19]

Labbe et al.

[11] 4,114,631

[45] Sep. 19, 1978

[54] CIGARETTE-MAKING MACHINES

[75] Inventors: Francis Auguste Maurice Labbe, Neuilly-sur-Seine, France; Ivan Yehudi Hirsh, London, England

[73] Assignee: Molins Limited, London, England

[21] Appl. No.: 115,952

[22] Filed: Feb. 17, 1971

[30] Foreign Application Priority Data

Feb. 17, 1970 [GB] United Kingdom ..... 7625/70

[51] Int. Cl.[2] ..... A24C 5/18

[52] U.S. Cl. ..... 131/84 C

[58] Field of Search ..... 131/84, 110

[56] References Cited

U.S. PATENT DOCUMENTS

| | | | |
|---|---|---|---|
| 2,833,290 | 5/1958 | Molins | 131/109 R |
| 2,972,993 | 2/1961 | Labbé | 131/84 B |
| 3,094,127 | 6/1963 | Gamberini | 131/84 B X |
| 3,315,685 | 4/1967 | Richter | 131/84 C |
| 3,608,562 | 9/1971 | Gomann | 131/84 C |
| 3,613,692 | 10/1971 | Gomann | 131/84 B |

FOREIGN PATENT DOCUMENTS

| | | |
|---|---|---|
| 654,863 | 12/1928 | France. |
| 1,125,826 | 3/1962 | Fed. Rep. of Germany. |
| 932,005 | 7/1963 | United Kingdom. |

*Primary Examiner*—Robert W. Michell
*Assistant Examiner*—V. Millin
*Attorney, Agent, or Firm*—John C. Smith, Jr.

[57] ABSTRACT

A cigarette making machine forms a tobacco stream on a moving air-pervious suction band by showering tobacco downwards through a chute which terminates in a narrow trough of which the depth increases progressively in the direction of motion of the band, with at least one air inlet for directing air obliquely downwards into the trough to pull the tobacco through the trough and towards the band. As the tobacco stream is formed on the band it acquires a depth which increases directly in accordance with the increasing height of the trough, in the direction of the motion of the band.

13 Claims, 5 Drawing Figures

FRANCIS A. M. LABBE
INVENTORS
IVAN YEHUDI HIRSH
Marsova, Smith + Kruger
ATTORNEYS

CIGARETTE-MAKING MACHINES

U.S. Pat. No. 3,125,099 describes a cigarette making machine in which tobacco is showered on to an air-pervious band to build up a tobacco stream which is subsequently enclosed in a wrapping to form a continuous cigarette rod. The tobacco stream built up against the band is compressed by the action of a differential air pressure which pulls the tobacco into a relatively narrow trough downstream of the shower zone, this trough being narrower in section than the channel through which the tobacco is showered and having a depth which increases progressively in the direction of movement of the band. Air flow through the shower channel carries the tobacco upwards towards the band, which runs along the top of the channel.

According to the present invention the tobacco is showered downwards under gravity through the shower channel (which will therefore be referred to as a "chute"). The chute terminates in a relatively narrow trough of progressively increasing depth into which the tobacco is pulled by means of a differential air pressure, the admission of air above the trough being through a side inlet just above the trough, so arranged that the air flows through the inlet in a direction extending downwards and inwardly inclined to the vertical. There are preferably air inlets on both sides of the trough.

This invention is particularly useful in the case of a machine including a trimmer which removes part of the top of the tobacco stream formed on the band.

Figure 1:
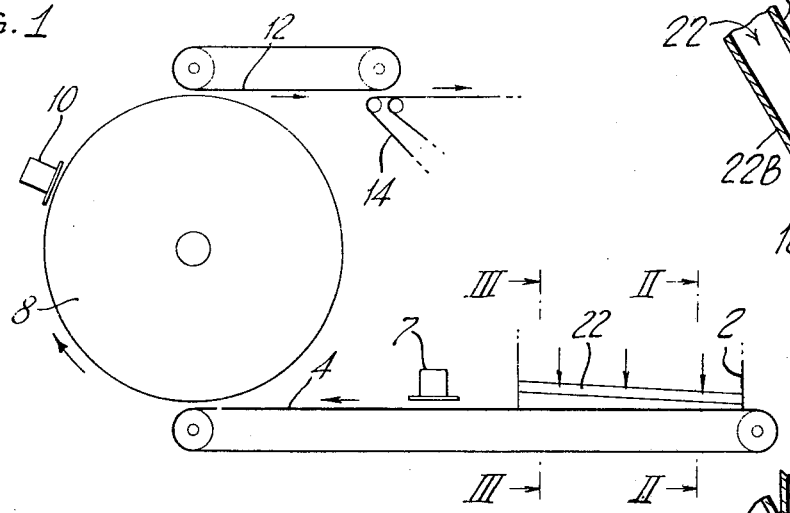
Figure 4:
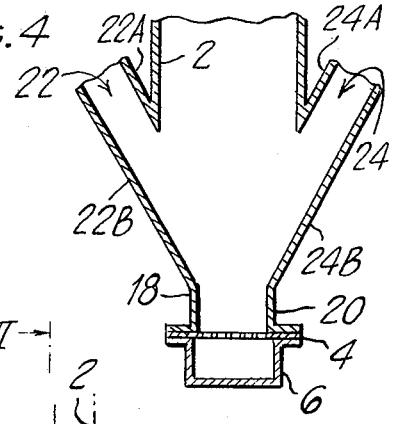
Figure 5:
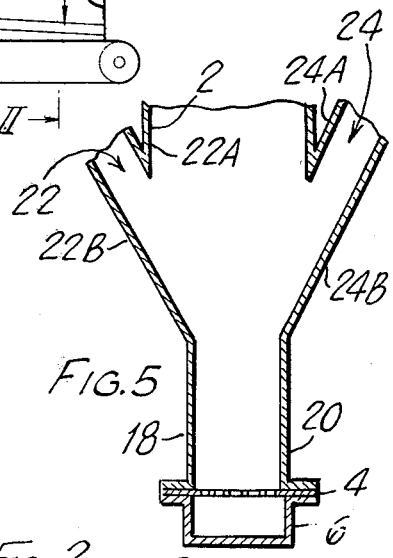
Figure 3:
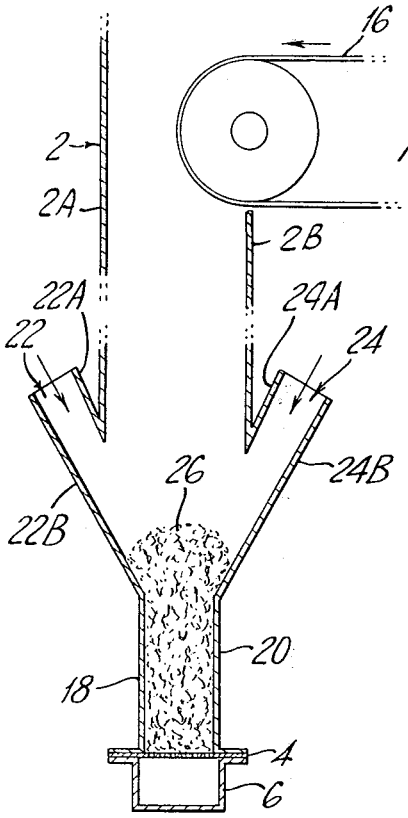
Figure 2:
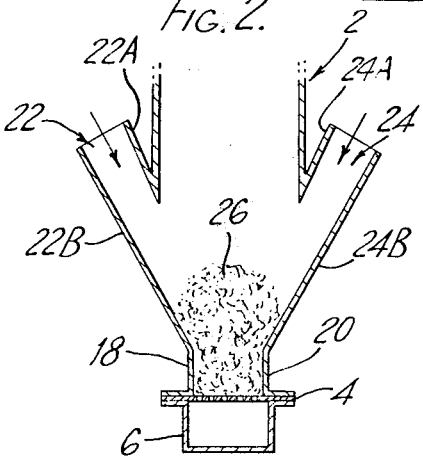

An example of a cigarette making machine according to this invention is shown in the accompanying drawings. In these drawings:

FIG. 1 is a diagrammatic overall view of the machine;

FIGS. 2 and 3 are respectively enlarged sections on the lines II—II and III—III in FIG. 1; and FIGS. 4 and 5 show a further embodiment similar to FIGS. 2 and 3 respectively.

As shown in FIG. 1, the machine includes a chute 2, comprising front and back walls 2A and 2B respectively, down which tobacco is showered to build up an appropriate stream on an air-pervious band 4 on which the stream is held in compression by means of suction in a chamber 6 (FIG. 2) below the band. Part of the top of the filler is removed by a trimmer 7; the remainder is transferred into a groove in a wheel 8 which carries the tobacco stream with the aid of suction past a second trimmer 10 and, releases the remainder of the tobacco stream when it reaches a suction transfer band 12 which carries the stream into a garniture in which a paper web 14 is wrapped round the tobacco to form a cigarette rod.

FIGS. 2 and 3 are sections through the chute 2. FIG. 3 also shows that the tobacco may for example be delivered into the chute (preferably in the form of substantially separated particles) by a wide conveyor band 16.

The chute terminates at the bottom in a trough having vertical side walls 18 and 20. The trough has a progressively increasing depth. It is relatively narrow compared with the chute; that is to say, the distance between the side walls 18 and 20 is small compared with the distance between the walls 2A and 2B of the chute. In the drawings the width of the trough (i.e., the distance between the side walls 18 and 20) is shown as constant, but the width could alternatively increase progressively in the direction of movement of the band as shown in FIGS. 4 and 5.

Above the trough there are air inlets 22 and 24 defined by upper walls 22A and 24A and lower walls 22B and 24B. Air flowing in through these inlets passes obliquely downwards and pulls the tobacco, shown at 26, progressively into the ever-deepening trough. As shown in FIG. 1, the centre line of the air inlet 24 (as also of the inlet 22) is inclined to the horizontal to allow for the desired progressively deepening trough.

FIG. 3 shows the trough at nearly its deepest point. It will be appreciated that the machine includes side walls (not shown) which form extensions of the side walls 18 and 20 beyond the shower region to confine the sides of the tobacco stream (at least part of the way up the sides) in its passage towards and beyond the trimmer 7.

The side walls 18 and 20 of the trough need not necessarily be straight and vertical at all sections as shown in FIGS. 2 and 3. They could for example be outwardly inclined and possibly convex inwards at the upstream end of the chute (i.e., at the right-hand end of FIG. 1) and approach progressively towards the final section in which they are preferably straight and vertical as shown in FIG. 3. The depth of the trough at the upstream end is preferably not more than 2 or 3mm. The width of the trough may for example be about 10mm.

It should be noted that the existence of the air inlets just above the trough means that the air flow downwards through the chute is negligible; the tobacco falls gently and substantially only under gravity. The head of loose tobacco (as seen in cross-section) which forms at the bottom of the trough, overlapping sideways over the lower walls 22B and 24B of the air inlets, is progressively pulled into the trough and compressed by the air coming in through the inlets.

What we claim as our invention and desire to secure by Letters Patent is:

1. A machine for making cigarettes and similar rod-like articles for smoking, comprising an air-pervious substantially horizontal conveyor band moving in a predetermined horizontal direction, a vertical chute terminating in a relatively narrow trough at its lower end portion, said band being positioned adjacent to and below said trough, said trough having a depth which increases progressively as seen in cross-section at various positions along the band spaced successively in the direction of movement of the band, means for showering tobacco downwards on to the band in a direction transverse to the band and through said chute, means for producing a differential air pressure for pneumatically urging the tobacco through the trough and towards the band to form a tobacco stream on the band, and means defining at least one elongated air inlet in said chute for the admission of air just above the trough, and for directing the air downwards towards the band at an angle to the vertical, the air inlet being at a height above the band which increases progressively in accordance with the increasing depth of the trough considered in the direction of movement of the band.

2. A machine according to claim 1 including a second inlet for air on the side of the chute opposite to the first inlet.

3. A machine according to claim 1 including a trimmer for removing the top of the stream of tobacco formed on the band.

4. A machine for making cigarettes and similar rod-like articles for smoking, comprising an air-pervious substantially horizontal conveyor band; a vertical chute extending downwards towards the conveyor band and for a substantial distance along the conveyor band; means for feeding tobacco downwards into the chute and on to the band in a direction transverse to the band; a trough lying along and immediately above the band and below the chute, the trough being formed by substantially vertical side walls spaced apart horizontally by a substantially fixed distance and having a height which increases progressively in the direction of movement of the band; means defining a suction chamber below the band; and means defining at least one air inlet above the trough formed partly by a wall extending along one side of the trough and having a bottom edge adjacent to the top edge of the adjacent vertical side wall of the trough, said wall being outwardly and upwardly inclined so as to direct the air downwards and obliquely across the trough, with the height of the air inlet above the band increasing progressively in the direction of motion of the band.

5. In a cigarette making machine, means for forming a tobacco stream, comprising:

a. a substantially horizontal air-pervious conveyor band, b. fixed trough walls mounted above the band and extending along opposite sides of the band, said walls having similar, substantially vertical, opposed inner surfaces spaced apart at a substantially uniform distance along the band, said inner surfaces extending perpendicularly from the band to a height which increases linearly along the band in the direction of movement of the band, c. fixed chute walls extending upwards from the tops of the trough walls and diverging upwardly, and d. means for showering tobacco along a path substantially vertically downwards on to the band at a substantially uniform rate along the band, and into the space between said inner surfaces of the trough walls, to progressively build up on the band a tobacco stream of which the height increases substantially directly with the progressively increasing height of the inner surfaces of the trough walls.

6. A machine according to claim 5 further comprising inlet means for admitting an air stream along the length of and immediately above at least one of said trough walls and means defining a suction chamber below said band for drawing said air stream through said tobacco stream and band to compress said tobacco stream, said inlet means being adapted to direct said air stream into said space between said trough walls at an acute angle with respect to said path of said showering tobacco.

7. Apparatus for forming a cigarette filler stream, comprising:

a. a substantially horizontal air-pervious conveyor band;

b. means defining a channel above the band and extending downwards towards the band for feeding tobacco along a path towards the band in a direction transverse to the band, whereby a tobacco stream builds up progressively on the band as the band passes below the channel;

c. fixed trough walls mounted above and along opposite sides of the band and having substantially parallel opposed inner surfaces for confining the sides of the tobacco on said band, said inner surfaces extending upwards from the band to a height which increases linearly along the band substantially directly in accordance with the increasing height of the tobacco stream as it builds up on the band during movement of the band below the channel; and d. suction means below the band for pneumatically compressing the tobacco stream against the band;

e. the channel including an inwardly and downwardly inclined portion immediately above at least one of the trough walls for guiding the tobacco towards the space between the inner surfaces of the trough walls.

8. A machine according to claim 7 further comprising inlet means for admitting an air stream along the length of and immediately above at least one of said trough walls, said suction means comprising a suction chamber below said band for drawing said air stream through said tobacco stream and band to compress said tobacco stream.

9. A machine according to claim 8 wherein said inlet means is adapted to direct said air stream into said space between said trough walls at an acute angle with respect to tobacco passing vertically downwards through said channel.

10. Apparatus for forming a cigarette filler stream, comprising:

a. a substantially horizontal air-pervious conveyor band, b. fixed elongated trough walls mounted above and along opposite sides of the band and having substantially parallel inner surfaces extending perpendicularly from the band to a height which increases linearly at successive positions spaced along the band in the direction of movement of the band, c. fixed chute walls extending upwards from the tops of the trough walls and diverging upwardly, d. means defining a suction chamber below the band, and e. means for delivering tobacco downwards on to and along the length of the band and towards the space between said trough walls at a rate sufficient to substantially fill the space between the trough walls at each position along the moving band, substantially directly in accordance with the increasing height of the tobacco stream as it builds up on the band during movement thereof.

11. A machine according to claim 10 further comprising inlet means for admitting an air stream along the length of and immediately above at least one of said trough walls.

12. A machine according to claim 11 wherein said inlet means is adapted to direct said air stream into said space between said trough walls at an acute angle with respect to the direction of the downward movement of said tobacco on to the band.

13. In a machine for the production of a tobacco filler rod, a tobacco stream forming apparatus comprising a trough including an elongated air-permeable tobacco transporting first wall arranged to travel lengthwise and having a first and second side, a pair of spaced-apart side walls adjacent to one side of said first wall and defining therewith an elongated channel extending in the direction of travel of said first wall, said channel including an elongated stream forming zone having an inner portion adjacent to said first wall and an outer portion outwardly adjacent to said inner portion, said side walls having spaced-apart first surfaces flanking said inner portion and spaced-apart second surfaces flanking said outer portion and diverging outwardly from the respective first surfaces so that the width of said outer portion between said second surfaces increases in a direction away from said first wall; means for showering particles of tobacco onto said first wall in said stream forming zone so that the particles thus showered form in said channel a growing stream whose height, as considered at right angles to said one side of said first wall, increases in the direction of travel of said first wall and which moves with said first wall in and beyond said stream forming zone, the height of said first surfaces, as considered at right angles to said one side of said first wall, increasing in the direction of travel of said first wall so that the depth of said inner portion of said stream forming zone, as considered at right angles to said one side of said first wall, increases at least substantially at the rate of growth of said stream; and suction generating means provided at the other side of said first wall to attract the tobacco stream to said one side.

* * * * *